United States Patent [19]

Kachenmeister, Jr. et al.

[11] Patent Number: 4,935,662

[45] Date of Patent: Jun. 19, 1990

[54] ELECTRIC LAMP HAVING A COILED INCANDESCENT FILAMENT AND FILAMENT MOVEMENT RESTRAINT MEANS

[75] Inventors: Carl F. Kachenmeister, Jr., Williamsport; Charles L. Gearhart, Montoursville, both of Pa.

[73] Assignee: GTE Products Corporation, Danvers, Mass.

[21] Appl. No.: 239,164

[22] Filed: Aug. 31, 1988

[51] Int. Cl.[5] ..... H01K 1/18

[52] U.S. Cl. ..... 313/279; 313/273

[58] Field of Search ..... 313/279, 315, 344, 273, 313/579

[56] References Cited

U.S. PATENT DOCUMENTS

| | | | |
|---|---|---|---|
| 3,930,177 | 12/1975 | Martin | 313/344 X |
| 4,208,609 | 6/1980 | Berlec | 313/344 X |
| 4,316,116 | 2/1982 | Graves et al. | 313/326 X |
| 4,499,401 | 2/1985 | Graves et al. | 313/315 |

*Primary Examiner*—Sandra O'Shea

*Attorney, Agent, or Firm*—Joseph S. Romanow

[57] ABSTRACT

An electric lamp having a coiled filament and at least one intermediate filament support which effectively restrains the filament from excessive swaying or sagging whereby premature lamp failure because of electrical shorting of the filament or thermal shocking of the glass envelope is substantially reduced. The intermediate filament support includes at least one flat segment interposed between two adjacent turns of the outermost coil of the filament. The maximum thickness of the flat segment is less than the winding separation of adjacent turns of the outermost coil. In preferred embodiments of the invention, the intermediate support encloses but does not grasp the filament so that no coil of the filament, inner or outer, is distended in the process of closing the support about the filament. A support in accordance with the invention effectively restrains filament movement in directions along and normal to the filamentary axis. The invention may be employed, singly or in multiples, in any incandescent lamp or any lamp employing an incandescent filament and is particularly appropriate for filaments designed to operate at relatively high voltages as is the situation in many European applications.

21 Claims, 2 Drawing Sheets

ELECTRIC LAMP HAVING A COILED INCANDESCENT FILAMENT AND FILAMENT MOVEMENT RESTRAINT MEANS

RELATED PATENT APPLICATIONS

U.S. patent applications with Ser. No. 238,967 filed Aug. 24, 1988 now U.S. Pat. No. 4,835,443 issued May 30, 1989 which is a continuation of Ser. No. 942,327 filed on Dec. 16, 1986, and Ser. No. 135,193 filed on Dec. 18, 1987, both being assigned to the assignee hereof, contain related subject matter.

TECHNICAL FIELD

This invention relates to electric lamps employing a coiled incandescent filament and more particularly to such lamps having filament movement restraint devices or intermediate filament supports to reduce or eliminate the possibility of the filament touching a lead-in wire or one point of a filament touching another point of the filament due to excessive filament movement.

BACKGROUND ART

When a mechanical shock or vibration is imparted to the outside of an operating electric lamp employing a coiled incandescent filament, the force of the impact may cause the lamp filament to sway or oscillate. If an operating filament is perturbed sufficiently so as to come into contact with one of the electrical lead-in wires between which the filament is connected, the filament will be electrically shorted which likely will result in premature failure of the filament and lamp.

In a lamp having a coiled filament positioned near the envelope wall, as is typical in many tungsten halogen lamps, premature lamp failure may occur as a result of the operating filament coming into contact with the glass wall. The thermal shock imparted by the hot filament may crack the glass envelope and cause lamp failure, possibly a violent failure.

The effect of gravity on a coiled filament, i.e., filament sag, may also give rise to premature lamp failure via shorting the filament or thermal shocking the glass envelope. When mounted horizontally, the filament has a catenary shape between filament supports. If jostled sufficiently, the middle section of an operating filament may come in contact with a lead-in wire or the envelope wall. When mounted vertically, numerous turns of filamentary coil may bunch near the lower end of the filament. If jostled sufficiently, a number of coil turns of an operating filament may come into electrical contact with each other resulting in a shorting of the filament.

The problem of filament sway or sag increases in severity as the length of the coiled filament increases and the diameter of the filamentary wire decreases. In order to achieve commercially feasible performance, such as lumen output and filament life, the design length and wire diameter of the filament are rather narrowly constrained. In filaments having design operating voltages of two hundred volts or higher, e.g., lamps for use in many European countries, commercially feasible filaments necessitate longer filaments with equivalent or thinner diameters than required in their lower voltage counterparts. Accordingly, additional or intermediate filament supports are commonly employed where filament sway or sag is a concern.

Use of an intermediate filament support is not without certain disadvantages, particularly with multiple coil filaments. Typically, an intermediate support is a hook or loop of wire having significantly more mass than the filamentary wire; the support hooks or grasps the filament. Mounting a filament on the heavier support may distend the filament turns near the mount. The relatively thick support wire may electrically short out two or three outermost turns of the filament, which may shorten the life of the filament. The more massive support may cool the filament appreciably in the vicinity of the mount which in turn may affect beneficial chemical reactions, such as the tungsten halogen cycle, between the operating filament and its environment.

In order to avoid these disadvantages, a loop of wire surrounding but not touching the filament has been employed as an intermediate support. While this type of support may restrain filament movement outside of the loop's perimeter, it does not deter movement along the filament's axis.

It would be a substantial advancement of the electric lamp art if an intermediate filament support were provided which substantially reduces one or more of the disadvantages associated with intermediate filament supports of the prior art, particularly if the new support may be employed without increasing the cost of lamp manufacture.

The following prior art patents are believed to be pertinent to the invention. In U.S. Pat. No. 4,743,803, issued May 10, 1988, to Lanese et al., particularly in FIGS. 10 and 11 thereof, there is disclosed an intermediate filament support which encircles the filament. The support may be mounted by means of a glass beam formed around one of the lead-in wires or by imbedding one end of the support in the press seal of the lamp's envelope. This patent contains a discussion of the filament shorting problem caused by mechanical shock or vibration.

The Martin patent, U.S. Pat. No. 3,930,177, issued Dec. 30, 1975, shows an hook-type intermediate filament support which is mounted in a glass bridge within the lamp's envelope.

An example of an intermediate filament support for a tubular incandescent lamp is shown in Morris et al., U.S. Pat. No. 4,359,665, issued Nov. 16, 1982. Also see U.S. Pat. Nos. 3,194,999, issued July 13, 1965, to Heinlein; 3,335,312, issued Aug. 8, 1967, to Cardwell, Jr.; 3,634,722, issued Jan. 11, 1972, to Palmer et al.; 3,678,319, issued July 18, 1972, to Notelteirs et al.; 3,736,455, issued May 29, 1973, to Notelteirs et al.; and 3,891,885, issued June 24, 1975, issued to Wurster; for further examples of intermediate supports in tubular lamps.

Two patents to Graves et al., U.S. Pat. Nos. 4,316,116, issued Feb. 16, 1982, and 4,499,401, issued Feb. 12, 1985, are noted for their discussions of single, double, and triple coiled filaments.

DISCLOSURE OF THE INVENTION

It is, therefore an object of the invention to obviate the deficiencies in the prior art.

It is another object of the invention to provide an electric lamp employing a coiled filament having an intermediate filament support wherein the support effectively restrains movement of the filament caused by mechanical shock or vibration of the lamp while substantially diminishing one or more of the negative effects on lamp performance typically associated with use of an intermediate support in the prior art.

It is a further object of the invention to provide an electric lamp employing a coiled filament having an intermediate filament support which effectively restrains filament sag, both in horizontally and vertically mounted filaments.

It is yet another object of the invention to provide an intermediate filament support which is well suited for use in tungsten halogen lamps employing coiled coil filaments or coiled coiled coil filaments.

It is still another object of the invention to provide an intermediate filament support which is well suited for use in electric lamps employing coiled filaments having high design operating voltages, such as two hundred volts and higher, wherein commercially feasible filaments are typically quite flimsy because of their length and thin-wire construction.

These objects are accomplished, in one aspect of the invention, by provision of an electric lamp comprising a light-transmissive envelope hermetically enclosing an interior. The envelope has a press seal formed in one end.

There are first and second electrical lead-in wires protruding into the interior of the arc tube. These lead-in wires provide means for supplying electrical power from an external source within the lamp envelope.

A coiled incandescent filament having a design operating voltage is mounted within the envelope. The filament has a central axis, a body, and two opposed ends. The body is formed from filamentary wire shaped in a helical coil with a plurality of turns about the central axis. The first end is electrically coupled with the first lead-in wire and the second end is electrically coupled with the second lead-in wire.

There is filament movement restraint means within the envelope. The restraint means includes at least one flat section interposed between two adjacent turns of the filamentary coil. The flat section has a maximum thickness which is less than the distance between the two adjacent turns.

In a second aspect of the invention, the lamp is identical with that described in the first aspect of the invention except that the filament is a coiled coil filament, the flat section of the restraint means is interposed between adjacent turns of the second coil, and the maximum thickness of the flat section of the restraint means is less than the distance between the adjacent turns of the second coil.

In a third aspect of the invention, the lamp is identical with that described in the second aspect of the invention except that the filament is a coiled coiled coil filament, the flat section of the restraint means is interposed between adjacent turns of the third coil, and the maximum thickness of the flat section of the restraint means is less than the distance between the adjacent turns of the third coil.

FIGS. *2a* and *2b* are isometric views of a preferred filament movement restraint means in accordance with the invention. FIG. *2a* shows a looped intermediate filament support with two flat segments in the open position; FIG. *2b* shows the support in the closed position, i.e., the position in which the looped support surrounds the filament.

FIGS. *3a* and *3b* are isometric views of an alternate filament movement restraint means in accordance with the invention. FIG. *3a* shows a triangular intermediate support having a V-shaped flat segment in the open position; FIG. *3b* shows the support in the closed position, i.e., the position in which the triangular support surrounds the filament.

BEST MODE FOR CARRYING OUT THE INVENTION

For a better understanding of the present invention, together with other and further objects, advantages, features, and capabilities thereof, reference is made to the following disclosure and appended claims taken in conjunction with the above-described drawings.

It has been found that undesirable movement of a coiled filament, e.g., filament sway or sag, may be effectively restrained by means of an intermediate filament support, or filament movement restraint means, which interposes a flat segment between adjacent turns of the outermost coil of the filament. As used herein, a "coiled" filament includes a filament having a single, double, or triple coil. The maximum thickness of the flat segment is less than the distance between adjacent turns of the outermost coil. Use of the flat segment substantially reduces one or more of the various disadvantages associated with typical intermediate filament supports of the prior art. An intermediate support in accordance with the invention is relatively simple to manufacture and install so that its use does not increase the price of the lamp.

Because the flat segment of the support is thinner than the distance between adjacent turns of the outermost coil of the filament, its insertion between the adjacent turns does not distort the outermost coil when the filament is mounted on or within the support. When electrical contact is made between the flat segment and the energized filament, at most two adjacent outermost turns of the filament are shorted by the segment. Just as the flat segment has minimal electrical contact with the filament, it likewise has minimal thermal contact. Thus, the flat segment has equivalent or less cooling effect on the filament in the vicinity of the mount than does its cylindrical wire counterparts. The flat segment prevents any significant filament movement along the central axis of the filament. The support may encircle or grasp an inner coil of the filament (or the filamentary wire in the case of a filament with a single coil) so that filament movement in directions normal to the central axis of the filament may also be effectively restrained.

Figure 1:
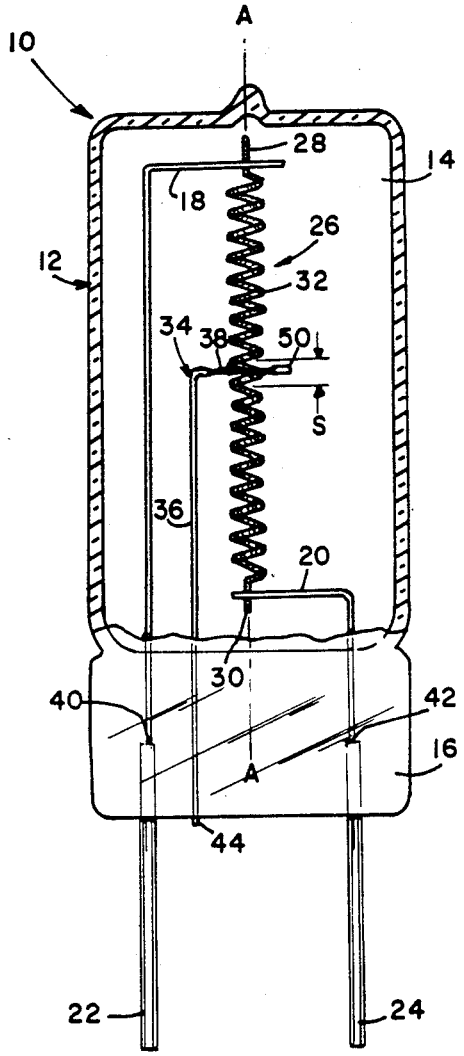
FIG. 1 is an elevational view, partially in cross-section, of a preferred embodiment of the invention showing a single ended tungsten halogen lamp with a coiled coil filament. The filament has an intermediate support, including a flat segment in accordance with the invention, mounted in the press seal.

FIG. 1 is an elevational view of a preferred embodiment of the invention. Lamp 10 comprises a single ended tungsten halogen lamp having a coiled coil filament with an intermediate filament support in accordance with the invention mounted in the press seal. In the embodiment of FIG. 1, lamp 10 is a low-wattage lamp, meaning that the rated wattage is one hundred and seventy-five watts or less. More particularly, lamp 10 includes light transmissive envelope 12 hermetically enclosing interior 14 with press seal 16 formed in one end. Envelope 12 may preferably be formed from a hard glass, such as aluminosilicate or borosilicate glass. In this embodiment, envelope 12 is single ended; however, the invention applies equally to double ended lamps.

First and second electrical lead-in wires 18 and 20 are mounted in press seal 16 and protrude into interior 14.

Lead-in wires 18 and 20 may be formed from molybdenum wire so that a hermetic seal between the lead-in wires and press seal is assured because of the closeness of the coefficients of thermal expansion of molybdenum and hard glass. Each molybdenum lead-in wire may be butt welded to another piece of wire, 22 and 24, respectively, formed from a suitable material, e.g., nickel plated steel, preferably of slightly larger diameter, in order to provide greater rigidity for supporting lamp 10. Weld points 40 and 42 may be imbedded in press seal 16.

Tungsten lamp filament 26 is mounted within interior 14. Filament 26 has central axis A—A, coiled coil body 32, and opposed ends 28 and 30. End 28 may be mounted on lead-in 18 and end 30 may be mounted on lead-in 20, e.g., by welding. Filament body 32 was constructed by forming the filamentary wire into a first, or inner, helical coil about a mandrel or first axis (not referenced in the drawing) and then forming the first coil into a second, or outer, helical coil about a central axis. As used herein, the term "outer coil" or "outermost coil" refers to the last helical coil formed in the process of constructing the filament. As may be seen in the drawing, both inner and outer coils of body 32 have a plurality of coil turns or windings. Distance S is the distance between the mid-points of adjacent coil turns of the outer coil of body 32 measured along filament axis A—A; S is also called the winding separation.

Filament 26 has a design operating voltage which, in the preferred embodiment of FIG. 1, is approximately one hundred and twenty volts. In order to achieve commercially feasible values of lumen output and filament life, filament 26 necessarily is formed from filamentary wire with a relatively thin diameter, approximately 0.004 inches. The length of body 32 is such that the filament is quite flimsy and therefore susceptible of considerable movement unless restrained. Accordingly, a filament movement restraint means in accordance with the invention is employed in lamp 10.

In the preferred embodiment of FIG. 1, the restraint means comprises intermediate filament support 34 including at least one flat section 38 interposed between two adjacent outer turns of body 32, as shown in the drawing. Body 32 is mounted on support 34 approximately in the middle of body 32 along axis A—A. The maximum thickness of flat section 38 is less than winding separation S so that the outermost coil of body 32 is not distended by the interposition of the flat segment. In this embodiment, support 34 encircles the inner coil of body 32 by means of the preferred loop structure shown in FIGS. 2*a* and 2*b*. The triangular structure shown in FIGS. 3*a* and 3*b* is an alternate embodiment of support 34. In either case, support 34 may be mounted in press seal 16 and, if so mounted, a choice of molybdenum wire for support 34 is preferred. After formation of press seal 16, wire 36 may be trimmed at location 44, close to the base of press seal 16, such that support 34 is electrically isolated from electrical lead-in wires 18 and 20. Preferred wire diameters for molybdenum wire 36, as well as for the molybdenum portions of lead-in wires 18 and 20, are in the range of approximately 0.004 to 0.020 inches for lamp 10.

Lamp 10, being a tungsten halogen lamp, includes a gaseous fill (not shown in the drawing) within interior 14 including a halogen, such as hydrogen bromide. An inert gas also may be present in the fill.

Figure 2A:
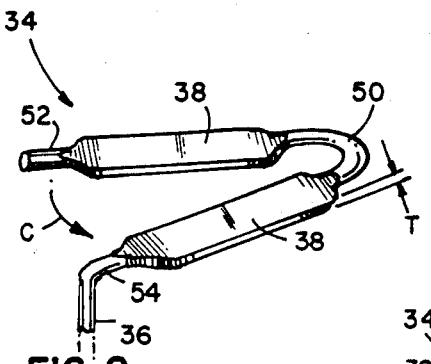
Figure 2B:
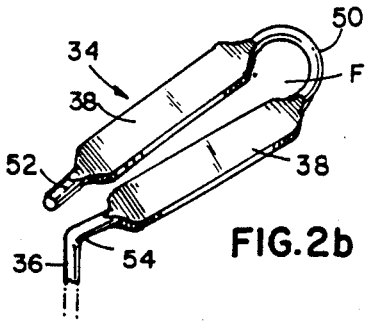
Figure 3A:
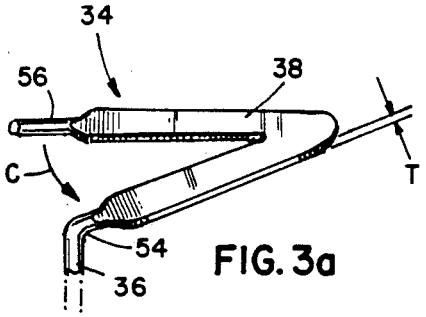
Figure 3B:
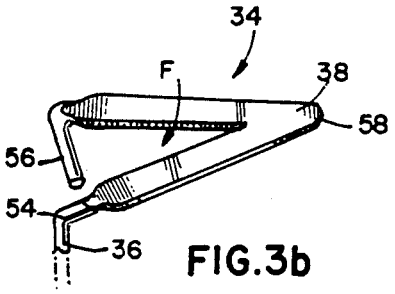

FIGS. 2*a* and 2*b* are isometric views of a preferred embodiment of a filament movement restraint means in accordance with the invention. In both drawings, wire portion 36 (which extends into press seal 16) has been shortened. FIG. 2*a* shows intermediate filament support 34 having two flat segments 38 of approximately the same length and thickness connected by curved wire segment 50. Particular choices for the various dimensions of support 34 must be matched to those of the filament to be mounted on the support.

Support 34 is in the open position in FIG. 2*a*. The support may be closed by moving or bending wire segment 52 in the direction of dashed arrow C toward elbow 54. Support 34 is shown in the closed position in FIG. 2*b* wherein the closed support is in the form of a loop. As used herein, the term "loop" or "looped" means that the support bends back to touch or almost touch itself. It is not necessary for segment 52 and elbow 54 to touch or cross each other. The loop should, however, be sufficiently closed to prevent a mounted filament from escaping from within the loop. The interior of the loop, within which an inner coil of the mounted filament will be confined, is indicated by reference F in FIG. 2*b*.

Thickness T of flat segments 38 is less than the winding separation S of the outermost coil of a mounted filament, so that the closing of support 34 about the filament does not distend the outermost coil of the filament. Preferably, no inner coil of the filament is distended by flat segments 38. Loop interior F may be sized such that support 34 firmly grasps an inner coil of the mounted filament or not. In the latter case, which is preferred, interior F is sized such that flat segments 38 are sufficiently interposed between adjacent turns of the outermost coil to prevent any significant movement of the filament along its central axis without the necessity of having the support firmly grasp the filament's inner coil (or the filamentary wire in the case of a filament with a single coil). Thus, there is no distension of any coil of the filament with the preferred sizing of support 34.

FIGS. 3*a* and 3*b* are isometric views of an alternate embodiment of a filament movement restraint means in accordance with the invention. In both drawings, wire portion 36 (which extends into press seal 16) has been shortened. FIG. 2*a* shows intermediate filament support 34 having V-shaped flat segment 38 with thickness T. Elbow 54 connects to one leg of the V-shape, and cylindrical wire segment 56 extends from the other end of the V-shape. Particular choices for the various dimensions of support 34 must be matched to those of the filament to be mounted on the support.

Support 34 is in the open position in FIG. 3*a*. The support may be closed by moving or bending wire segment 56 in the direction of dashed arrow C toward elbow 54. Support 34 is shown in the closed position in FIG. 3*b* wherein the closed support is in the form of a triangular loop. As noted above, it is not necessary for segment 56 and elbow 54 to touch or cross each other. The triangular loop should, however, be sufficiently closed to prevent a mounted filament from escaping from within the interior of the loop. The interior of the loop, within which an inner coil of the mounted filament will be confined, is indicated by reference F in FIG. 3*b*. In the embodiment of FIG. 3*b*, the triangular shape of the loop is approximately in the form of an isosceles triangle with each leg of V-shaped flat segment 38 corresponding respectively to one of the equal legs of the isosceles triangle.

Thickness T of V-shaped flat segment 38 is less than the winding separation S of the outermost coil of a mounted filament, so that the closing of the triangular support 34 about the filament does not distend the outermost coil of the filament. Loop interior F may be sized such that triangular support 34 firmly grasps an inner coil of the mounted filament or not. In the latter case, which is preferred, interior F is sized such that V-shaped flat segment 38 is sufficiently interposed between adjacent turns of the outermost coil to prevent any significant movement of the filament along its central axis without the necessity of having the support firmly grasp the filament's inner coil (or the filamentary wire in the case of a filament with a single coil). Thus, there is no distension of any coil of the filament with the preferred sizing of triangular support 34.

The embodiment of support 34 shown in FIGS. 2*a* and 2*b* is preferred over that of FIGS. 3*a* and 3*b* because the former embodiment is somewhat easier to close about the filament's inner coil and the latter embodiment may buckle somewhat at point 58 of the V-shaped segment during closing of the triangular loop.

The flattened section (or sections) of the intermediate filament support is preferably formed by first shaping the support from cylindrical molybdenum wire and then flattening the desired portion or portions of the wire, such as by pressing or rolling. Alternatively, flattened segments may be preformed and welded to connecting wire Portions of the support.

In a laboratory example of lamp 10 in accordance with the invention, the filament was designed to operate at 90 watts with 120 volts average of alternating current. The filament was a coiled coil tungsten filament with a winding separation of 0.017 inches and a filamentary wire diameter of approximately 0.004 inches. The flattened sections of the looped (not triangular) intermediate filament support had a maximum thickness in the range of approximately 0.005 to approximately 0.006 inches. The wire diameter of the molybdenum portions of the lead-in wires and the cylindrical molybdenum intermediate support wire was 0.013 inches. The length of the body of the filament was roughly 0.600 inches.

An intermediate filament support in accordance with the invention may be employed, singly or in multiples, in any incandescent lamp or any lamp employing an incandescent filament. The filament may be operated in any orientation in either single-ended or double-ended lamps. This type of support is particularly appropriate with incandescent filaments designed to operate at higher voltages, (say, average voltages of two hundred volts or greater) as is common in many European countries, because commercially feasible filaments for these applications typically require relatively long filaments and thin filamentary diameters.

While there have been shown what are at present considered to be preferred embodiments of the invention, it will be apparent to those skilled in the art that various changes and modifications can be made herein without departing from the scope of the invention as defined by the appended claims.

We claim:

1. An electric lamp comprising:

(a) a light-transmissive envelope hermetically enclosing an interior, said envelope having a press seal formed in one end thereof;

(b) first and second electrical lead-in wires protruding into said interior, said lead-in wires providing means for supplying electrical power from an external source within said envelope;

(c) a coiled incandescent filament having a design operating voltage mounted within said envelope, said filament having a central axis, a body, and two opposed ends, said body being formed from filamentary wire shaped in a helical coil with a plurality of turns about said central axis, said first end being electrically coupled with said first lead-in wire, said second end being electrically coupled with said second lead-in wire;

(d) filament movement restraint means within said envelope, said restraint means including at least one flat section interposed between two adjacent turns of said coil, said flat section having a maximum thickness which is less than the distance between said two adjacent turns.

2. A lamp as described in claim 1 wherein said lamp further includes a gaseous fill within said interior, said fill including a halogen.

3. A lamp as described in claim 1 wherein said design operating voltage of said filament is greater than one hundred and thirty volts.

4. A lamp as described in claim 1 wherein said lamp is an incandescent lamp and said filament is mounted on said lead-in wires.

5. A lamp as described in claim 1 wherein a portion of said restraint means is loop shaped and encircles a segment of said filamentary wire of said body of said filament.

6. A lamp as described in claim 5 wherein said loop-shaped portion includes three substantially straight legs formed substantially in the shape of an isosceles triangle and each of the two equal legs of said isosceles triangle includes said flat section.

7. A lamp as described in claim 5 wherein said loop-shaped portion includes two legs of approximately equal length connected by a curved segment, said legs converging toward each other such that an acute angle is substantially formed between them with said curved segment subtending said acute angle, and each of said legs includes said flat section.

8. A lamp as described in claim 1 wherein said lamp is single ended.

9. A lamp as described in claim 1 wherein said lamp is a tubular lamp.

10. A lamp as described in claim 1 wherein said restraint means is mounted in said press seal.

11. An electric lamp comprising:

(a) a light-transmissive envelope hermetically enclosing an interior, said envelope having a press seal formed in one end thereof;

(b) first and second electrical lead-in wires protruding into said interior, said lead-in wires providing means for supplying electrical power from an external source within said envelope;

(c) a coiled coil incandescent filament having a design operating voltage mounted within said envelope, said filament having a central axis, a body, and two opposed ends, said body being formed from filamentary wire shaped in first and second helical coils with said second helical coil being about said central axis, each of said coils having a plurality of turns, said first end being electrically coupled with said first lead-in wire, said second end being electrically coupled with said second lead-in wire;

(d) filament movement restraint means within said envelope, said restraint means including at least one flat section interposed between two adjacent turns of said second coil, said flat section having a maximum thickness which is less than the distance between said two adjacent turns.

12. A lamp as described in claim 11 wherein said lamp further includes a gaseous fill within said interior, said fill including a halogen.

13. A lamp as described in claim 11 wherein said design operating voltage of said filament is greater than two hundred volts.

14. A lamp as described in claim 11 wherein said lamp is an incandescent lamp and said filament is mounted on said lead-in wires.

15. A lamp as described in claim 11 wherein a portion of said restraint means is loop shaped and encircles a segment of said filamentary wire of said body of said filament.

16. A lamp as described in claim 15 wherein said loop-shaped portion includes three substantially straight legs formed substantially in the shape of an isosceles triangle and each of the two equal legs of said isosceles triangle includes said flat section.

17. A lamp as described in claim 15 wherein said loop-shaped portion includes two legs of approximately equal length connected by a curved segment, said legs converging toward each other such that an acute angle is substantially formed between them with said curved segment subtending said acute angle, and each of said legs includes said flat section.

18. A lamp as described in claim 15 wherein said lamp is single ended.

19. A lamp as described in claim 11 wherein said lamp is a tubular lamp.

20. A lamp as described in claim 11 wherein said restraint means is mounted in said press seal.

21. An electric lamp comprising:

(a) a light-transmissive envelope hermetically enclosing an interior, said envelope having a press seal formed in one end thereof;

(b) first and second electrical lead-in wires protruding into said interior, said lead-in wires providing means for supplying electrical power from an external source within said envelope;

(c) a coiled coiled coil incandescent filament having a design operating voltage mounted within said envelope, said filament having a central axis, a body, and two opposed ends, said body being formed from filamentary wire shaped in first, second, and third helical coils with said third helical coil being about said central axis, each of said coils having a plurality of turns, said first end being electrically coupled with said first lead-in wire, said second end being electrically coupled with said second lead-in wire;

(d) filament movement restraint means within said envelope, said restraint means including at least one flat section interposed between two adjacent turns of said third coil, said flat section having a maximum thickness which is less than the distance between said two adjacent turns.

* * * * *